US008685122B2

(12) United States Patent
Murakami et al.

(10) Patent No.: US 8,685,122 B2
(45) Date of Patent: Apr. 1, 2014

(54) FUEL GASIFICATION EQUIPMENT

(75) Inventors: Takahiro Murakami, Tokyo (JP); Satoko Aoki, Tokyo (JP); Toshiyuki Suda, Tokyo (JP); Hidehisa Tani, Tokyo (JP)

(73) Assignee: IHI Corporation, Tokyo (JP)

( * ) Notice: Subject to any disclaimer, the term of this patent is extended or adjusted under 35 U.S.C. 154(b) by 477 days.

(21) Appl. No.: 13/058,793

(22) PCT Filed: Aug. 20, 2008

(86) PCT No.: PCT/JP2008/002243

§ 371 (c)(1),
(2), (4) Date: Feb. 22, 2011

(87) PCT Pub. No.: WO2010/021010

PCT Pub. Date: Feb. 25, 2010

(65) Prior Publication Data

US 2011/0131881 A1 Jun. 9, 2011

(51) Int. Cl.
*B01J 7/00* (2006.01)

(52) U.S. Cl.
USPC ..... 48/61

(58) Field of Classification Search
None
See application file for complete search history.

(56) References Cited

U.S. PATENT DOCUMENTS 2,618,588 A * 11/1952 Jahnig ..... 201/28
2,618,589 A * 11/1952 Nicholson et al. ..... 201/4
4,191,544 A * 3/1980 Boll et al. ..... 96/150
4,441,892 A * 4/1984 Schuster ..... 48/197 R
4,464,183 A * 8/1984 Arisaki ..... 48/210
5,033,413 A * 7/1991 Zenz et al. ..... 122/4 D
2010/0143208 A1* 6/2010 Van Der Meijden et al. . 422/144

FOREIGN PATENT DOCUMENTS

| | | |
|---|---|---|
| JP | 59 81933 | 6/1984 |
| JP | 11-201423 | 7/1999 |
| JP | 2000 257828 | 9/2000 |
| JP | 2003 42424 | 2/2003 |
| JP | 2006-207947 | 8/2006 |
| JP | 2006-213817 | 8/2006 |
| JP | 2006 292275 | 10/2006 |

OTHER PUBLICATIONS

International Search Report issued Nov. 18, 2008 in PCT/JP08/002243 filed Aug. 20, 2008.
U.S. Appl. No. 13/059,007, filed Feb. 22, 2011, Murakami, et al.

* cited by examiner

*Primary Examiner* — Imran Akram
(74) *Attorney, Agent, or Firm* — Oblon, Spivak, McClelland, Maier & Neustadt, L.L.P.

(57) ABSTRACT

Provided is a fuel gasification equipment capable of sufficiently contacting particulates of a solid fuel with a bed material without scattering and reliably completing pyrolysis of the solid fuel to achieve improvement in cold gas efficiency and in C and H conversion rates and reforming of tar in a gasification gas. A fuel supply pipe 14 is connected to a side surface of a gasification furnace 2 at a position lower than an upper surface of a fluidized bed 1 for supplying the solid fuel into the fluidized bed 1. Confluence promoting means 15 is provided to allow the solid fuel supplied from the fuel supply pipe 14 into the fluidized bed 1 to join a flow of the bed material supplied from the downcomer 7 to an inner bottom of the fluidized bed 1.

1 Claim, 7 Drawing Sheets

FUEL GASIFICATION EQUIPMENT

TECHNICAL FIELD

The present invention relates to a fuel gasification equipment.

BACKGROUND ART

A fuel gasification equipment has been developed which uses as fuel solid fuel such as coal, biomass, waste plastic or various wet wastes to produce a gasification gas.

FIGS. 1 and 2 show an example of a conventional fuel gasification equipment comprising a gasification furnace 2 having a fluidized bed 1 of a bed material (such as silica sand or limestone) formed by steam and a fluidizing reaction gas such as air or oxygen to gasify a solid fuel (such as coal or biomass) charged for production of a gasification gas and a flammable solid content, a combustion furnace 5 fed with the flammable solid content produced in the gasification furnace 2 along with the bed material through an introduction pipe 3 and having a fluidized bed 4 formed by a fluidizing reaction gas to burn the flammable solid content, a material separator 8 such as a hot cyclone for separating the bed material from an exhaust gas introduced via an exhaust gas pipe 6 from the combustion furnace 5 to supply the separated bed material to the gasification furnace 2 via a downcomer 7, a material separator 9 such as a hot cyclone for separating a bed material from the gasification gas produced by the gasification furnace 2 and a recovery receptacle 10 for recovering the bed material separated by the separator 9.

In FIGS. 1 and 2, reference numeral 11 denotes a distribution plate for uniformly blowing into the fluidized bed 1 the steam and the fluidizing reaction gas introduced to the bottom of the gasification furnace 2; 12, a partition wall for covering an inner portion of the gasification furnace 2 connected to the introduction pipe 3 such that only a bottom of the portion is opened to prevent the bed material in the fluidized bed 1 from directly flowing out into the introduction pipe 3; 13, a distribution plate for uniformly blowing into the fluidized bed 4 the fluidizing reaction gas introduced to the bottom of the combustion furnace 5; and 14' denotes a fuel supply pipe connected to a side surface of the gasification furnace 2 at a position higher than an upper surface of the fluidized bed 1.

In the above-mentioned gasification equipment, the fluidized bed 1 is formed in the gasification furnace 2 by the steam and the fluidizing reaction gas such as air or oxygen. A solid fuel such as coal and biomass, which is charged through the fuel supply pipe 14' into the fluidized bed 1, is partially oxidized for gasification to produce a gasification gas and a flammable solid content. The flammable solid content produced by the gasification furnace 2 is introduced through the introduction pipe 3 along with the bed material into the combustion furnace 5 having the fluidized bed 4 formed by the fluidizing reaction gas to burn the flammable solid content. An exhaust gas from the combustion furnace 5 is introduced through the exhaust gas pipe 6 into the material separator 8 such as a hot cyclone where the bed material is separated from the exhaust gas. The separated bed material is returned through the downcomer 7 to the gasification furnace 2 for circulation.

Since a high temperature is retained in the gasification furnace 2 in the presence of the steam supplied to the bottom of the gasification furnace 2 and moisture evaporated from the solid fuel itself and a gas produced by pyrolysis of the solid fuel and a residual fuel are react with the steam, a water gasification reaction $C+H_2O=H_2+CO$ and a hydrogen conversion reaction $CO+H_2O=H_2+CO_2$ occur, producing a combustible gasification gas such as $H_2$ and CO.

From the gasification gas produced by the gasification furnace 2, the bed material is separated by the material separator 9 such as a hot cyclone and is recovered to the recovery receptacle 10.

An equipment configuration similar to the fuel gasification equipment shown in FIGS. 1 and 2 is disclosed, for example, in Patent Literature 1.

Patent Literature 1: JP 2006-207947A

SUMMARY OF INVENTION

Technical Problems

Whenever a solid fuel is gasified in the gasification furnace 2, tar and a lower hydrocarbon gas are produced and are reformed through contact with the bed material into gasification gases such as $H_2$ and CO. However, in a case where the solid fuel is supplied from the fuel supply pipe 14' onto the fluidized bed 1 of the gasification furnace 2 as shown in the conventional example shown in FIGS. 1 and 2, particulates of the solid fuel may scatter with no sufficient contact with the bed material, disadvantageously resulting in difficulty to complete the pyrolysis of the solid fuel; as a result, an obtained gas heat quantity, i.e., cold gas efficiency is reduced while C and H conversion rates are less increased.

The invention was conceived in view of the above and has its object to provide a fuel gasification equipment capable of sufficiently contacting the particulates of the solid fuel with the bed material without scattering and reliably completing the pyrolysis of the solid fuel to achieve improvement in cold gas efficiency, improvement in C and H conversion rates and reforming of tar in the gasification gas.

Solution to Problems

The invention is directed to a fuel gasification equipment comprising:

a gasification furnace with a fluidized bed of a bed material formed by a fluidizing reaction gas for gasifying a solid fuel charged to produce a gasification gas and a flammable solid content;

a downcomer arranged to supply a bed material from above the gasification furnace to an inner bottom of the fluidized bed;

a fuel supply pipe connected to a side surface of said gasification furnace at a position lower than an upper surface of the fluidized bed for supplying a solid fuel into the fluidized bed; and confluence promoting means which allows the solid fuel supplied from the fuel supply pipe into the fluidized bed to join a flow of the bed material supplied from the downcomer to the inner bottom of the fluidized bed.

According to the above-mentioned measures, the following effects are obtained.

When configured as described above, particulates of the solid fuel sufficiently contact with the bed material without scattering as compared to the conventional case of supplying the solid fuel from the fuel supply pipe onto the fluidized bed of the gasification furnace, and the confluence promoting means allows the solid fuel supplied from the fuel supply pipe into the fluidized bed to join the flow of the bed material supplied from the downcomer to the inner bottom of the fluidized bed to facilitate the diffusion throughout the fluidized bed, so that the pyrolysis of the solid fuel is reliably completed and the obtained gas heat quantity, i.e., cold gas efficiency is increased while the C and H conversion rates are increased and tar in the gasification gas can be reformed.

In the fuel gasification equipment, said confluence promoting means may be provided by defining a portion of the downcomer by the side surface of said gasification furnace and by connecting the fuel supply pipe to a lower end of the downcomer, which enables the solid fuel to reliably join a downward flow of the bed material in the downcomer and to diffuse throughout the fluidized bed.

In the fuel gasification equipment, said confluence promoting means may be alternatively provided by an inclined surface on a bottom of the gasification furnace which guides the solid fuel supplied from said fuel supply pipe into said fluidized bed to a vicinity of the lower end of the downcomer, which causes the solid fuel supplied from the fuel supply pipe into the fluidized bed to be guided along the inclined surface to the vicinity of the lower end of the downcomer and to diffuse throughout the fluidized bed along with the bed material supplied from the downcomer to the inner bottom of the fluidized bed.

In the fuel gasification equipment, said confluence promoting means may be alternatively provided by setting a depth in said gasification furnace substantially equal to an outer diameter of the downcomer and by setting a distance between the downcomer and the side surface of the gasification furnace connected to the fuel supply pipe at least equal to or less than an inner diameter of the fuel supply pipe, which causes the solid fuel supplied from the fuel supply pipe into the fluidized bed to be reliably guided to the lower end of the down comer from between the downcomer and the side surface of the gasification furnace connected to the fuel supply pipe and to diffuse throughout the fluidized bed along with the bed material supplied from the downcomer to the inner bottom of the fluidized bed.

Advantageous Effects of Invention

The fuel gasification equipment of the invention can achieve excellent effects that the particulates of the solid fuel can sufficiently contact with the bed material without scattering and that the pyrolysis of the solid fuel can be reliably completed to achieve the improvement in cold gas efficiency, the improvement in C and H conversion rates and the reforming of tar in the gasification gas.

REFERENCE SIGNS LIST

Figure 1:
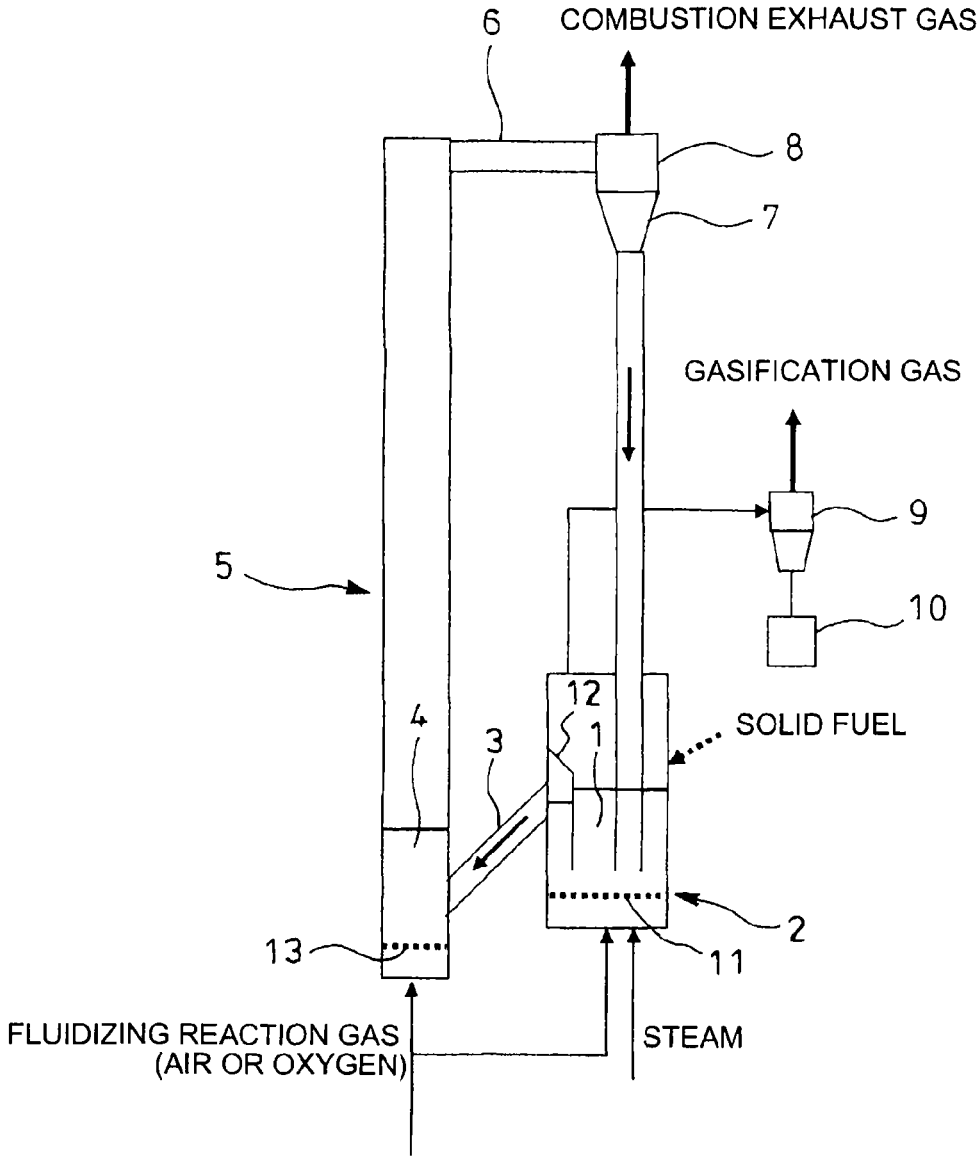
FIG. 1 CONVENTIONAL ART
FIG. 1 is an overall schematic diagram of an example of a conventional fuel gasification equipment.

1 fluidized bed
2 gasification furnace
3 introduction pipe
5 combustion furnace
7 downcomer
8 material separator
10 recovery receptacle
11 distribution plate
12 partition wall
14 fuel supply pipe
15 confluence promoting means
16 inclined surface
D0 depth
D1 outer diameter
D2 distance
D3 inner diameter

DESCRIPTION OF EMBODIMENTS

Embodiments of the invention will be described with reference to the accompanying drawings.

Figure 2:
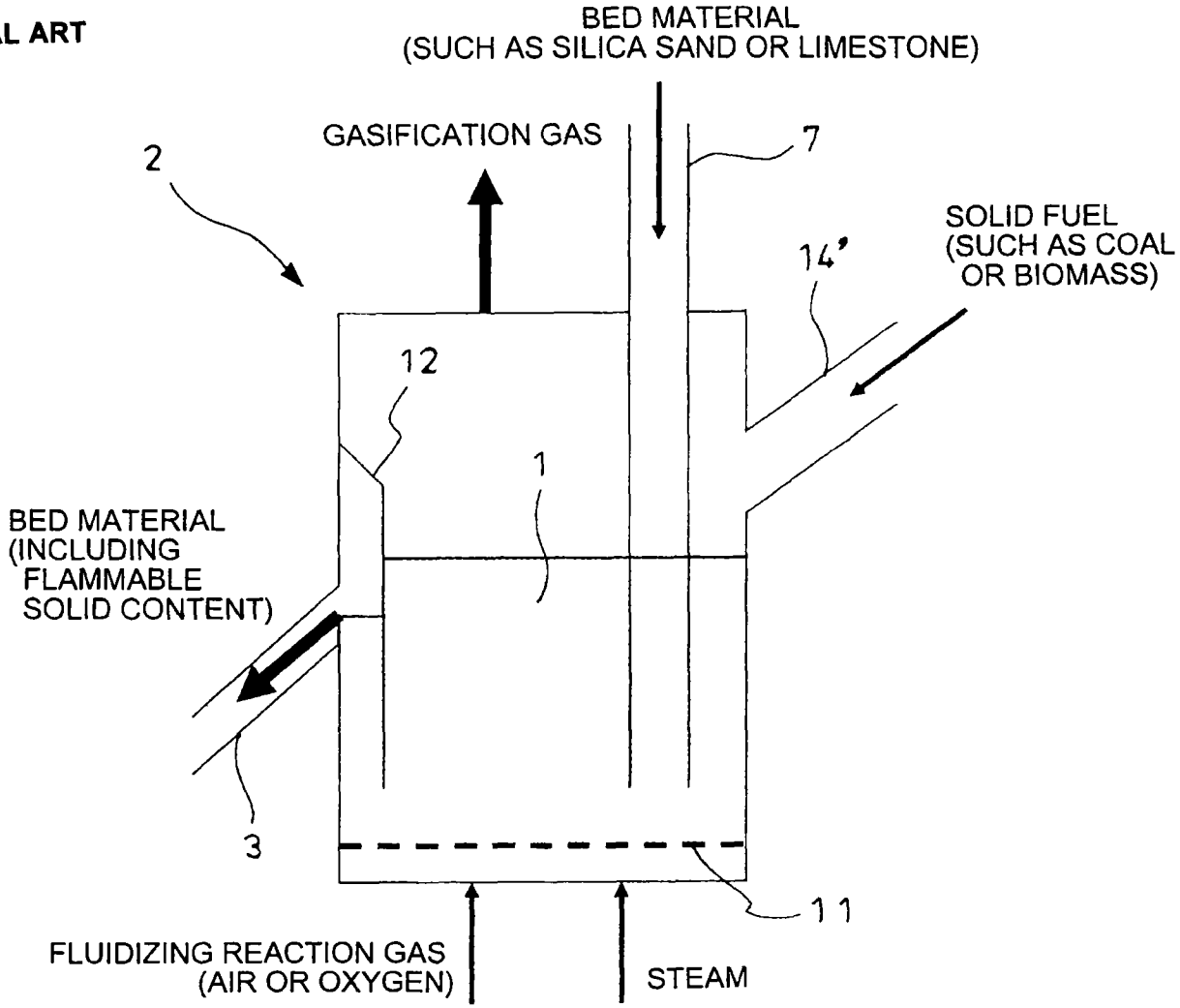
FIG. 2 CONVENTIONAL ART
FIG. 2 is a relevant part diagram showing a gasification furnace in the example of the conventional fuel gasification equipment.
Figure 3:
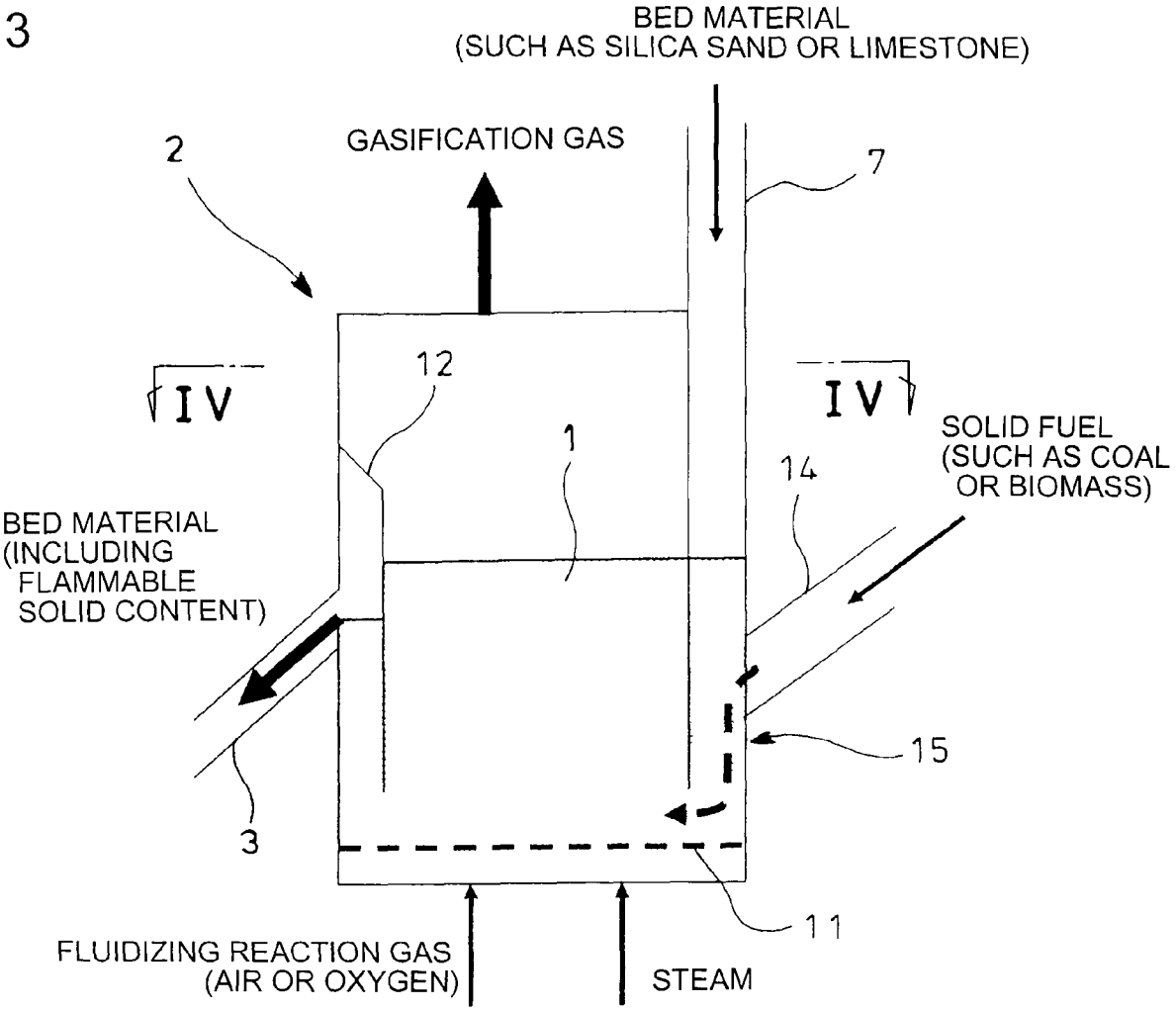
FIG. 3 is a relevant part diagram showing a gasification furnace in a first embodiment of the invention.
Figure 4:
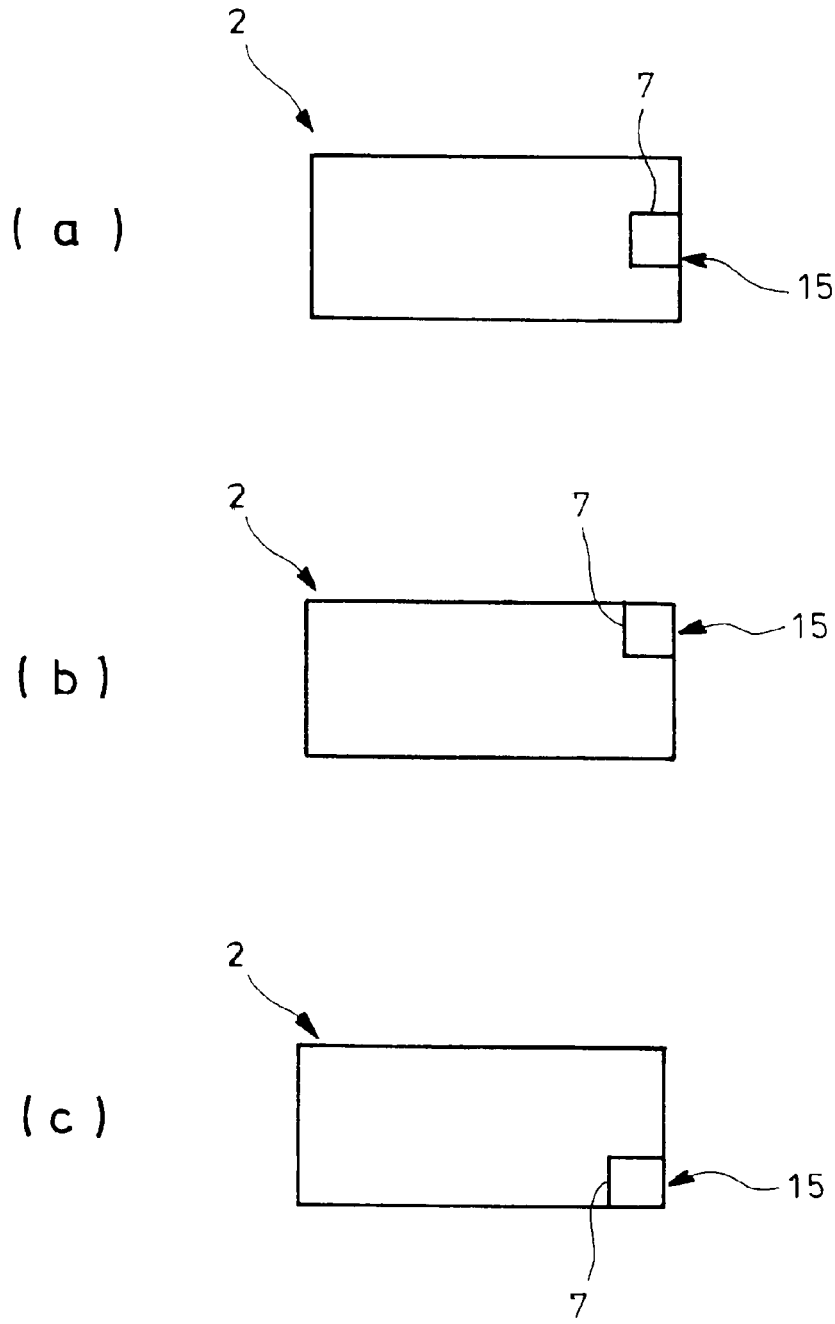
FIG. 4 is diagrams corresponding to a cross-section taken along IV-IV in FIG. 3, FIG. 4(*a*) showing an example with confluence promoting means formed centrally in a depth direction of the gasification furnace, FIGS. 4(*b*) and 4(*c*) showing examples with the confluence promoting means formed at corners of the gasification furnace.

FIGS. 3 and 4 show a first embodiment of the invention. In the figures, parts similar to those in FIGS. 1 and 2 are represented by the same reference numerals. The embodiment, which is similar in basic configuration to the conventional one shown in FIGS. 1 and 2, is characteristic as shown in FIGS. 3 and 4 in that a fuel supply pipe 14 is connected to a side surface of a gasification furnace 2 at a position lower than the upper surface of a fluidized bed 1 to supply a solid fuel from the fuel supply pipe 14 into the fluidized bed 1 and that confluence promoting means 15 is included which allows the solid fuel supplied from the fuel supply pipe 14 into the fluidized bed 1 to join a flow of the bed material supplied from the downcomer 7 to an inner bottom of the fluidized bed 1.

In this embodiment, the confluence promoting means 15 is provided by defining a portion of the downcomer 7 by a side surface of the gasification furnace 2 and by connecting the fuel supply pipe 14 to a lower end of the downcomer 7. The confluence promoting means 15 may be provided centrally in the depth direction of the gasification furnace 2 (the top-bottom direction in FIG. 4) as depicted in FIG. 4(*a*); alternatively, it may be formed at a corner of the gasification furnace 2 as shown in FIG. 4(*b*) or 4(*c*).

An operation of the embodiment will be described.

As mentioned in the above, the fuel supply pipe 14 is connected to the side surface of the gasification furnace 2 at a position lower than the upper surface of the fluidized bed 1 to supply the solid fuel from the fuel supply pipe 14 into the fluidized bed 1, so that particulates of the solid fuel sufficiently contact with the bed material without scattering as compared to the conventional case of supplying the solid fuel from the fuel supply pipe 14' onto the fluidized bed 1 of the gasification furnace 2 as shown in FIGS. 1 and 2. Moreover, the confluence promoting means 15 provided by defining the portion of the downcomer 7 by the side surface of the gasification furnace 2 and by connecting the fuel supply pipe 14 to the lower end of the downcomer 7 allows the solid fuel supplied from the fuel supply pipe 14 into the fluidized bed 1 to reliably join the downward flow of the bed material in the downcomer 7 for easy diffusion throughout the fluidized bed 1. As a result, the pyrolysis of the solid fuel is reliably completed and an obtained gas heat quantity, i.e., cold gas efficiency is increased while C and H conversion rates are increased and tar in the gasification gas can be reformed.

Thus, the particulates of the solid fuel can sufficiently contact with the bed material without scattering and the pyrolysis of the solid fuel can be reliably completed to achieve the improvement in cold gas efficiency, the improvement in C and H conversion rates and the reforming of tar in the gasification gas.

Figure 5:
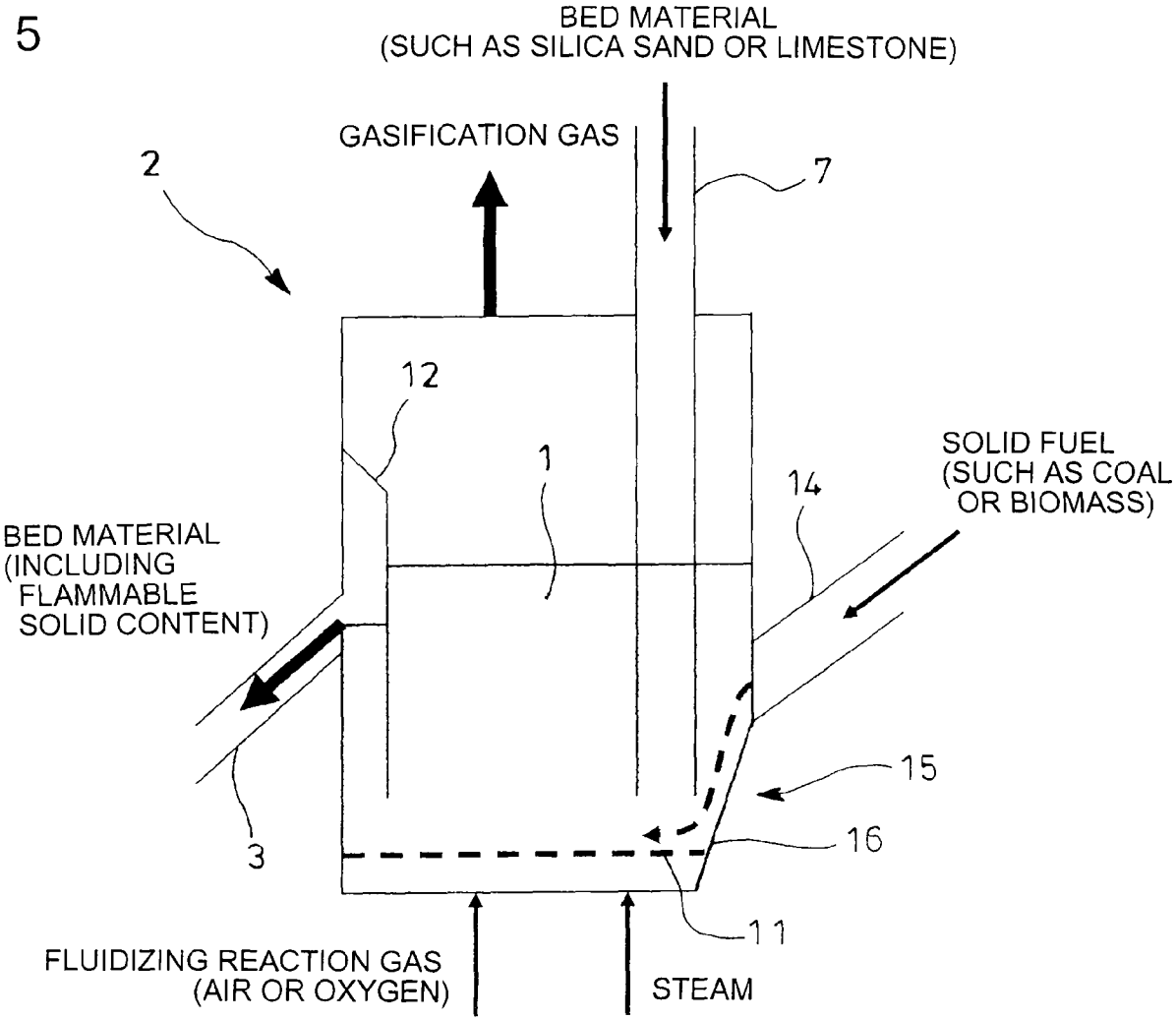
FIG. 5 is a relevant part diagram of the gasification furnace in a second embodiment of the invention.

FIG. 5 shows a second embodiment of the invention. In the figure, parts similar to those in FIGS. 1 and 2 are represented by the same reference numerals. The embodiment, which is similar in basic configuration to the conventional one shown in FIGS. 1 and 2, is characteristic as shown in FIG. 5 in that the fuel supply pipe 14 is connected to the side surface of the gasification furnace 2 at a position lower than the upper surface of the fluidized bed 1 to supply a solid fuel from the fuel supply pipe 14 into the fluidized bed 1 and that the confluence promoting means 15 is provided by an inclined surface 16 on a bottom of the gasification furnace 2 which guides the solid fuel supplied from the fuel supply pipe 14 into the fluidized bed 1 to a vicinity of the lower end of the downcomer 7.

When configured as in the second embodiment shown in FIG. 5, the particulates of the solid fuel sufficiently contact with the bed material without scattering as compared to the conventional case of supplying the solid fuel from the fuel supply pipe 14' onto the fluidized bed 1 of the gasification furnace 2 as shown in FIGS. 1 and 2. Moreover, the solid fuel supplied from the fuel supply pipe 14 into the fluidized bed 1 is guided to the vicinity of the lower end of the downcomer 7 along the inclined surface 16 for easy diffusion throughout the fluidized bed 1 along with the bed material supplied from the downcomer 7 to the inner bottom of the fluidized bed 1 because of the confluence promoting means 15 provided by the inclined surface 16 on the bottom portion of the gasification furnace 2 which guides the solid fuel supplied from the fuel supply pipe 14 into the fluidized bed 1 to the vicinity of the lower end of the downcomer 7. Thus, the pyrolysis of the solid fuel is reliably completed and an obtained gas heat quantity, i.e., cold gas efficiency is increased while C and H conversion rates are increased and tar in the gasification gas can be reformed.

Thus, also in the case of the second embodiment shown in FIG. 5, as in the case of the first embodiment shown in FIGS. 3 and 4, the particulates of the solid fuel can sufficiently contact with the bed material without scattering and the pyrolysis of the solid fuel can be reliably completed to achieve the improvement in cold gas efficiency, the improvement in C and H conversion rates and the reforming of tar in the gasification gas.

Figure 6:
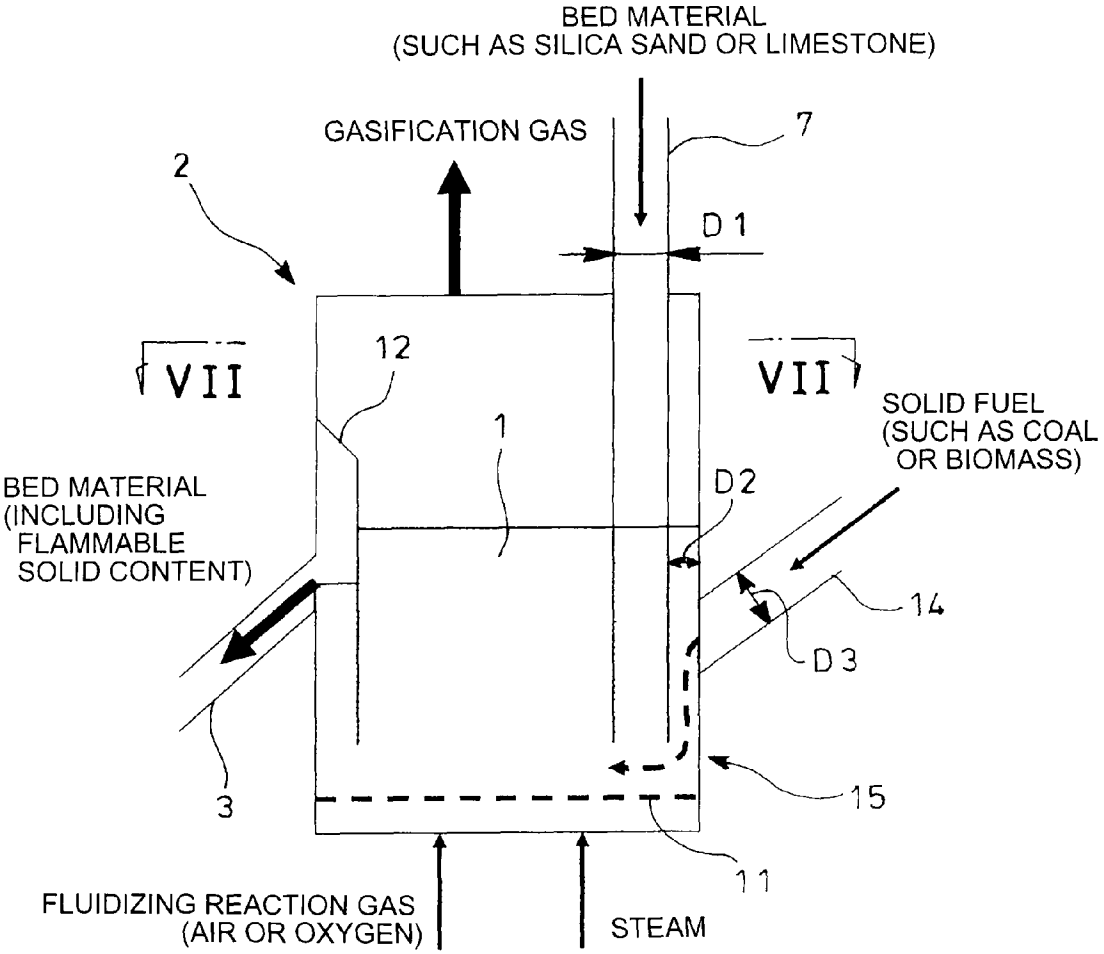
FIG. 6 is a relevant part diagram of the gasification furnace in a third embodiment of the invention.
Figure 7:
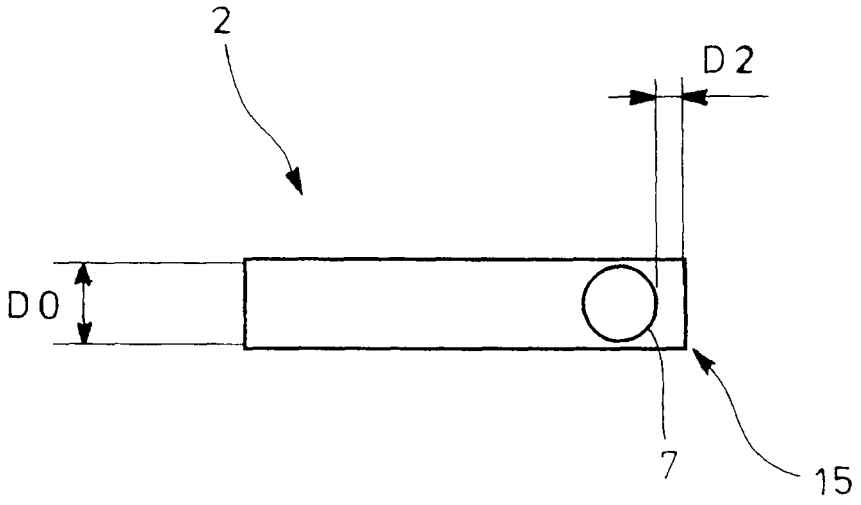
FIG. 7 is a diagram corresponding to a cross-section taken along VII-VII in FIG. 6.

FIGS. 6 and 7 show a third embodiment of the invention. In the figures, parts similar to those in FIGS. 1 and 2 are represented by the same reference numerals. The embodiment, which is similar in basic configuration to the conventional one shown in FIGS. 1 and 2, is characteristic as shown in FIG. 5 in that the fuel supply pipe 14 is connected to the side surface of the gasification furnace 2 at a position lower than the upper surface of the fluidized bed 1 to supply a solid fuel from the fuel supply pipe 14 into the fluidized bed 1 and that the confluence promoting means 15 is provided by setting a depth D0 in the gasification furnace 2 substantially equal to an outer diameter D1 of the downcomer 7 and by setting a distance D2 between the downcomer 7 and the side surface of the gasification furnace 2 connected to the fuel supply pipe 14 at least equal to or less than an inner diameter D3 of the fuel supply pipe 14.

In FIG. 7, the downcomer 7 is shown as a pipe having a circular cross-section; it goes without saying that alternatively the downcomer 7 may be a pipe having a rectangular cross-section as shown in FIG. 4.

When configured as in the third embodiment shown in FIGS. 6 and 7, the particulates of the solid fuel sufficiently contact with the bed material without scattering as compared to the conventional case of supplying the solid fuel from the fuel supply pipe 14' onto the fluidized bed 1 of the gasification furnace 2 as shown in FIGS. 1 and 2, and the solid fuel supplied from the fuel supply pipe 14 into the fluidized bed 1 is reliably guided to the lower end of the down comer 7 from between the downcomer 7 and the side surface of the gasification furnace 2 connected to the fuel supply pipe 14 and diffuses throughout the fluidized bed 1 along with the bed material supplied from the downcomer 7 to the inner bottom of the fluidized bed 1 because of the confluence promoting means 15 provided by setting the depth D0 in the gasification furnace 2 substantially equal to the outer diameter D1 of the downcomer 7 and by setting the distance D2 between the downcomer 7 and the side surface of the gasification furnace 2 connected to the fuel supply pipe 14 at least equal to or less than the inner diameter D3 of the fuel supply pipe 14.

Therefore, in the case of the third embodiment depicted in FIGS. 6 and 7, as in the case of the first embodiment shown in FIGS. 3 and 4 and the second embodiment shown in FIG. 5, the particulates of the solid fuel can sufficiently contact with the bed material without scattering and the pyrolysis of the solid fuel can be reliably completed to achieve the improvement in cold gas efficiency, the improvement in C and H conversion rates, and the reforming of tar in the gasification gas.

It is to be understood that the fuel gasification equipment of the invention is not limited to the above-mentioned embodiments and that various changes and modifications may be applied within a range not departing from the spirit of the invention.

The invention claimed is:

1. A fuel gasification equipment comprising:

a gasification furnace with a fluidized bed of a bed material formed by a fluidizing reaction gas for gasifying a solid fuel charged to produce a gasification gas and a flammable solid content;

a fluidizing reaction gas source connected to the gasification furnace;

a downcomer provided at least partially in the gasification furnace arranged to supply a bed material from above the gasification furnace to an inner bottom of the fluidized bed;

a fuel supply pipe connected to a side surface of said gasification furnace at a position lower than an upper surface of the fluidized bed for supplying a solid fuel into the fluidized bed; and confluence promoting means which allows the solid fuel supplied from the fuel supply pipe into the fluidized bed to join a flow of the bed material supplied from the downcomer to the inner bottom of the fluidized bed, said confluence promoting means being defined by a depth in said gasification furnace equal to an outer diameter of the downcomer and by a distance between the downcomer and the side surface of the gasification furnace connected to the fuel supply pipe at least equal to or less than an inner diameter of the fuel supply pipe.

* * * * *